US010482836B2

(12) United States Patent
Gao et al.

(10) Patent No.: US 10,482,836 B2
(45) Date of Patent: Nov. 19, 2019

(54) GATE DRIVER AND CONFIGURATION SYSTEM AND CONFIGURATION METHOD THEREOF

(71) Applicants: Boe Technology Group Co., Ltd., Beijing (CN); Chongqing BOE Optoelectronics Technology Co., Ltd., Chongqing (CN)

(72) Inventors: Xianyong Gao, Beijing (CN); Yihjen Hsu, Beijing (CN); Lijun Xiao, Beijing (CN); Shuai Hou, Beijing (CN); Bo Xu, Beijing (CN); Lisheng Liang, Beijing (CN); Siqing Fu, Beijing (CN); Fei Shang, Beijing (CN); Haijun Qiu, Beijing (CN)

(73) Assignees: BOE TECHNOLOGY GROUP CO., LTD., Beijing (CN); CHONGQING BOE OPTOELECTRONICS TECHNOLOGY CO., LTD., Chongqing (CN)

( * ) Notice: Subject to any disclaimer, the term of this patent is extended or adjusted under 35 U.S.C. 154(b) by 206 days.

(21) Appl. No.: 15/515,610

(22) PCT Filed: Sep. 27, 2016

(86) PCT No.: PCT/CN2016/100306

§ 371 (c)(1),
(2) Date: Mar. 30, 2017

(87) PCT Pub. No.: WO2017/063500

PCT Pub. Date: Apr. 20, 2017

(65) Prior Publication Data

US 2017/0301305 A1 Oct. 19, 2017

(30) Foreign Application Priority Data

Oct. 16, 2015 (CN) ..... 2015 1 0670568

(51) Int. Cl.
*G09G 3/36* (2006.01)

(52) U.S. Cl.
CPC ..... *G09G 3/3677* (2013.01); *G09G 3/3696* (2013.01); *G09G 2310/08* (2013.01); *G09G 2320/0223* (2013.01); *G09G 2330/02* (2013.01)

(58) Field of Classification Search
CPC ..... G09G 2310/08; G09G 2330/02; G09G 3/3677; G09G 3/3696; G09G 2320/0223
See application file for complete search history.

(56) References Cited

U.S. PATENT DOCUMENTS 5,434,599 A * 7/1995 Hirai ..... G09G 3/3622 345/100
6,441,562 B1 * 8/2002 Kim ..... G09G 3/20 315/169.1

(Continued)

FOREIGN PATENT DOCUMENTS

CN 102023667 4/2011
CN 102023667 A 4/2011

(Continued)

OTHER PUBLICATIONS

International Search Report and Written Opinion from PCT/CN16/100306 dated Dec. 30, 2016.

(Continued)

*Primary Examiner* — Michael J Jansen, II
(74) *Attorney, Agent, or Firm* — Calfee, Halter & Griswold LLP

(57) ABSTRACT

A gate driver, a configuration system, and configuration method thereof is provided. The gate driver is used for providing a gate drive signal for a TFT array substrate and comprises at least a drive capability detection module and a drive capability adjustment module. The configuration system is configured to configure the driving capabilities of a (Continued)

plurality of gate drivers and comprises a controller provided outside the plurality of gate drivers. The driving capability of the gate driver becomes adjustable and configurable. The well balance of the drive capabilities of the drive control signals received by the different TFT array regions driven by the plurality of gate drivers configured by the configuration system can avoid the occurrence of a splitting-screen phenomenon.

16 Claims, 4 Drawing Sheets

(56) References Cited

U.S. PATENT DOCUMENTS 6,816,144 B2 * 11/2004 Tsuchi ..... G09G 3/3688 345/100
7,342,561 B2 * 3/2008 Hiraki ..... G09G 3/3688 345/204
7,466,302 B2 * 12/2008 Kim ..... G09G 3/3406 315/154
7,746,338 B2 * 6/2010 Shino ..... G09G 3/22 345/212
8,054,280 B2 * 11/2011 Choi ..... G09G 3/3685 345/100
8,125,478 B2 * 2/2012 Lin ..... G09G 3/3696 345/212
8,259,052 B2 * 9/2012 Lee ..... G09G 3/3648 345/100
8,289,098 B2 * 10/2012 Chang ..... G09G 3/3677 332/115
8,390,345 B2 * 3/2013 Kim ..... G09G 3/296 327/108
8,446,402 B2 * 5/2013 Sang ..... G09G 3/3696 345/204
8,531,374 B2 * 9/2013 Kao ..... G09G 3/20 345/100
8,717,349 B2 * 5/2014 Tsai ..... G09G 3/3688 345/213
8,817,007 B2 * 8/2014 Lee ..... G05F 1/56 323/282
8,860,700 B2 * 10/2014 Wen ..... G09G 3/3648 345/204
8,928,640 B2 * 1/2015 Chang ..... G09G 3/3655 345/208
9,269,326 B2 * 2/2016 Lin ..... G09G 5/00
9,319,036 B2 * 4/2016 Chang ..... H03K 5/12
9,330,626 B2 * 5/2016 Wang ..... G09G 3/3688
9,626,925 B2 * 4/2017 Cheng ..... G09G 3/3648
9,791,966 B2 * 10/2017 Lee ..... G06F 3/0416
9,799,300 B2 * 10/2017 Xiong ..... G09G 3/3677
9,881,573 B2 * 1/2018 Chang ..... G09G 3/3655
9,997,123 B2 * 6/2018 Takenaka ..... G09G 3/3648
10,204,588 B2 * 2/2019 Liu ..... G09G 3/3685
10,229,634 B2 * 3/2019 Zhang ..... G09G 3/3266
10,269,292 B2 * 4/2019 Bae ..... G09G 5/18
10,275,089 B2 * 4/2019 Kim ..... G06F 3/0418
2002/0047557 A1 4/2002 Kim
2003/0006955 A1 * 1/2003 Tsuchi ..... G09G 3/3688 345/92
2004/0041778 A1 * 3/2004 Hiraki ..... G09G 3/3688 345/100
2005/0134548 A1 * 6/2005 Kim ..... G09G 3/3406 345/102
2006/0197733 A1 * 9/2006 Lee ..... G09G 3/3648 345/100
2006/0256101 A1 11/2006 Shino et al.
2008/0266276 A1 * 10/2008 Choi ..... G09G 3/3685 345/204
2009/0079727 A1 * 3/2009 Ozawa ..... G09G 3/3233 345/214
2009/0278780 A1 * 11/2009 Lin ..... G09G 3/3696 345/98
2010/0283777 A1 * 11/2010 Sang ..... G09G 3/3696 345/212
2011/0050677 A1 * 3/2011 Tsai ..... G09G 3/3688 345/213
2011/0069059 A1 * 3/2011 Lee ..... G05F 1/56 345/212
2011/0121755 A1 * 5/2011 Han ..... H05B 33/0815 315/294
2011/0291709 A1 * 12/2011 Kim ..... G09G 3/296 327/134
2011/0316640 A1 * 12/2011 Chang ..... G09G 3/3677 332/116
2012/0062526 A1 * 3/2012 Wen ..... G09G 3/3648 345/204
2012/0062534 A1 * 3/2012 Kao ..... G09G 3/20 345/208
2012/0293485 A1 * 11/2012 Chang ..... H03K 5/12 345/213
2013/0088470 A1 * 4/2013 Chang ..... G09G 3/3655 345/208
2014/0028652 A1 * 1/2014 Lin ..... G09G 5/00 345/212
2014/0118324 A1 5/2014 Chan et al.
2014/0168046 A1 * 6/2014 Wang ..... G09G 3/3688 345/92
2014/0333608 A1 * 11/2014 Okairi ..... G09G 3/3648 345/214
2015/0077409 A1 * 3/2015 Chang ..... G09G 3/3655 345/208
2015/0279297 A1 10/2015 Nakano et al.
2016/0179275 A1 * 6/2016 Lee ..... G06F 3/0416 345/174
2016/0284297 A1 * 9/2016 Cheng ..... G09G 3/3648
2016/0343341 A1 * 11/2016 Kwak ..... G09G 3/3677
2016/0379581 A1 * 12/2016 Takenaka ..... G09G 3/3648 345/212
2017/0011683 A1 * 1/2017 Bae ..... G09G 5/18
2017/0090673 A1 * 3/2017 Kim ..... G06F 3/0418
2017/0162165 A1 * 6/2017 Xiong ..... G09G 3/3677
2017/0213510 A1 * 7/2017 Takenaka ..... H02M 3/156
2017/0301305 A1 * 10/2017 Gao ..... G09G 3/3677
2018/0158428 A1 * 6/2018 Liu ..... G09G 3/3685
2018/0301082 A1 * 10/2018 Zhang ..... G09G 3/3266

FOREIGN PATENT DOCUMENTS

CN 103578393 2/2014
CN 103578393 A 2/2014
CN 105139824 12/2015
KR 20110057594 6/2011
KR 20110057594 A 6/2011

OTHER PUBLICATIONS

First Office Action for Chinese Patent Application No. 201510670568.9 dated Apr. 26, 2017.
Extended Search Report for European Patent Application No. 16847618.2 dated Mar. 14, 2019.

* cited by examiner

GATE DRIVER AND CONFIGURATION SYSTEM AND CONFIGURATION METHOD THEREOF

RELATED APPLICATIONS

The present application is the U.S. national phase entry of PCT/CN2016/100306, with an international filing date of Sep. 27, 2016, which claims the benefit of Chinese Patent Application No. 201510670568.9, filed on Oct. 16, 2015, the entire disclosures of which are incorporated herein by reference.

TECHNICAL FIELD

The present disclosure relates to a TFT array driving technology for a thin film transistor (TFT) display panel, and to a gate driver for providing a gate drive signal for a TFT array substrate, and more particularly to a gate driver capable of outputting a gate drive signal having an adjustable driving capability, a configuration system and a configuration method for configuring a plurality of gate drivers to equalize the driving capabilities among them.

BACKGROUND

In a thin film transistor liquid crystal display (TFT-LCD), it is necessary to use a gate driver to drive and control the TFT array. As the resolution of the TFT-LCD becomes higher, the number of gate drivers needed increases. Different gate drivers drive and control the different TFT array regions of the display panel. Similarly, the same gate driver also has different fan-out ends to drive different fan-out sub-regions of the TFT array region corresponding to the gate driver.

Different gate drivers are arranged at different locations of the display panel, and thus the wirings or routings from the outputs of the gate drivers at different locations to the corresponding TFT array region (e.g., the wirings on the glass substrate between the gate drivers and the TFT array regions) are different from each other. For example, different lengths lead to different impedances. That is to say, the difference between the external wirings of the different gate drivers results in a difference between the drive control signals which are finally reflected in the TFT array regions. This difference is mainly reflected in the difference between the rising times of the drive control signals in the form of voltage pulse signal. That is, the rising times taken from the low level (VGL) to the high level (VGH) are different from each other. In the gate driving signals or the driving control signals of their corresponding TFT array regions, the time difference from VGL to VGH mainly affects their corresponding driving capabilities.

SUMMARY

In view of the above problems, the present disclosure provides the following technical solutions.

According to an aspect, an embodiment of the present disclosure proposes a gate driver for providing a gate drive signal for a thin film transistor array substrate, the gate driver comprising: a driving capability detection module configured to detect a driving capability of the gate drive signal and output a detection signal of the driving capability; and a driving capability adjustment module configured to adjust the driving capability of the gate drive signal based on the detection signal of the driving capability.

In some embodiments, the driving capability detection module is configured to receive at least a feedback signal collected from the gate drive signal and to detect the driving capability of the gate drive signal based at least on the feedback signal, the driving capability being represented by a rising time from low level to high level of the gate drive signal in the form of voltage pulse signal.

In some embodiments, the driving capability adjustment module is configured to adjust the driving capability of the gate drive signal based on an adjustment instruction generated based on the detection signal and configured and input from outside.

In some embodiments, the driving capability detection module comprises: a comparator configured to have a first input end input with a reference voltage signal and a second input end input with the feedback signal collected from the gate drive signal, wherein the comparator compares the feedback signal with the reference voltage signal to determine whether the gate drive signal has risen from a low level to the reference voltage; and a timing sub-module for determining the time period taken by the gate drive signal to rise from the low level to the reference voltage and outputting the detection signal based on the time period.

In some embodiments, the timing sub-module comprises a counter which counts the time period taken by the gate drive signal to rise from the low level to the reference voltage using a standard clock signal and outputs a count value.

In some embodiments, the driving capability detection module comprises a reference voltage signal providing sub-module comprising a first resistor and a second resistor arranged in series, the first input end of the comparison sub-module being electrically connected to a node between the first resistor and the second resistor.

In some embodiments, the reference voltage signal providing sub-module is configured as a signal source generating the gate drive signal.

In some embodiments, the driving capability adjustment module comprises: a driving capability adjustment component provided in a push-pull output circuit of the gate driver, and a register for configurably storage of the adjustment instruction which is a digital signal; wherein the driving capability adjustment component is adjusted and controlled by the adjustment instruction in the register.

In some embodiments, the driving capability adjustment component is a digital potentiometer or a digital capacitor, or a circuit formed by a digital potentiometer or a digital capacitor.

In some embodiments, the push-pull output circuit comprises a first MOS transistor and a second MOS transistor arranged in series; the first MOS transistor is connected to a signal source having a high level, and the second MOS transistor is connected to a signal source having a low level, and the driving capability adjusting component is provided in series between the first MOS transistor and the second MOS transistor; wherein the feedback signal is collected at a node between the second MOS transistor in the push-pull output circuit and the driving capability adjusting component.

In some embodiments, the detection signal is a digital signal.

According to another aspect, an embodiment of the present disclosure provides a configuration system for configuring driving capabilities of a plurality of gate drivers as described above, the various gate drivers being used for driving different thin film transistor array regions of a thin film transistor array substrate respectively, the configuration system comprising:

a plurality of gate drivers as described above;

a controller for storing said detection signals output from the plurality of gate drivers and comparing the respective detection signals corresponding to the plurality of gate drivers respectively to output different adjustment instructions corresponding to the various gate drivers, such that the driving capabilities of the various drive control signals obtained after the gate drive signals are output from the various gate drivers to the respective thin film transistor array regions are relatively consistent.

In some embodiments, the plurality of gate drivers are provided on a same thin film transistor array substrate.

In some embodiments, the controller is configured with a driving capability configuration rule and outputs the adjustment instructions based on a comparison result between the configuration rule and the detection signals.

In some embodiments, the driving capability configuration rule is set according to the driving capability differences between the gate drive signals output by the plurality of gate drivers and/or the external wiring conditions corresponding to the plurality of gate drivers.

In some embodiments, the detection signal is output through an external pin of the gate driver and is transmitted to the controller via an I2C communication line external to the gate driver.

According to another aspect, an embodiment of the present disclosure provides a method of configuring driving capabilities of a plurality of gate drivers, comprising the steps of:

receiving feedback signals collected from the gate drive signals output from the plurality of gate drivers;

detecting driving capabilities of the gate driving signals based on the feedback signals, and outputting detection signals that reflect the driving capabilities of the gate driving signals;

comparing the respective detection signals corresponding to the plurality of gate drivers to output different adjustment instructions corresponding to the different gate drivers, respectively, adjusting the driving capabilities of the gate drive signals in accordance with the adjustment instructions such that the driving capabilities of the various drive control signals obtained after the gate drive signals are output from the various gate drivers to the respective thin film transistor array regions are relatively consistent.

In some embodiments, the method further comprises driving the same thin film array substrate with the output signals of the plurality of gate drivers after adjusted and configured.

In some embodiments, the adjustment instruction is generated based on a comparison result between a pre-set driving capability configuration rule and the detection signal.

In some embodiments, the driving capability configuration rule is set according to the driving capability difference between the gate drive signals output by the plurality of gate drivers and/or the external wiring conditions corresponding to the plurality of gate drivers.

The driving capability of the gate driver of the present disclosure can be detected and become adjustable so that after adjustment by the configuration system of the present disclosure, the drive control signals received by the different TFT array regions corresponding to the plurality of gate drivers respectively have uniform driving capabilities, which can avoid the phenomenon of splitting-screen.

BRIEF DESCRIPTION OF DRAWINGS

The above and other objects and advantages of the present disclosure will become more complete and apparent from the following detailed description made in conjunction with the accompanying drawings in which like or similar elements are denoted by like reference numerals.

DETAILED EMBODIMENTS

Some of multiple of possible embodiments of the present disclosure are described below, which are intended to provide a basic understanding of the present disclosure and are not intended to identify the key or determinative elements of the invention or to define a protection scope. It will be readily understood that other implementations which can replace each other may be proposed by those ordinary skilled in the art without departing from the spirit of the invention, in accordance with the technical solution of the present disclosure. Accordingly, the following detailed implementations and accompanying drawings are only illustrative of the technical solutions of the present disclosure and should not be construed as the whole invention or as definitions or limitations of technical solutions of the present invention.

In the present context, the "gate drive signal" refers to a signal directly output by the gate driver for driving the TFT array region, which has not been transmitted by external wiring or routing, and the "drive control signal" refers to a signal received by the TFT array area, which is a signal become by the gate drive signal after passing through the wiring between the gate driver and the TFT array region.

Herein, the driving capability of the gate drive signal or the drive control signal is represented by the rise time taken by the signal changing from the low level VGL to the high level VGH, and can also be understood as the VGH rising speed.

Figure 1:
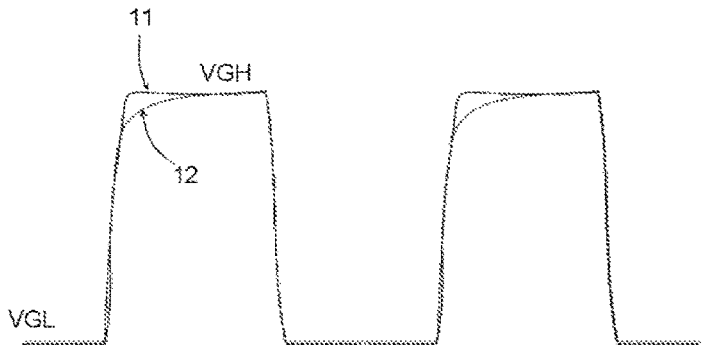
(PRIOR ART) Fig. 1
FIG. 1 is an comparison diagram of drive control signals obtained after the gate drive signals of the two gate drivers are output to the respective TFT array regions, in prior art.

FIG. 1 is a comparison diagram of the drive control signals obtained after the gate drive signals of the two gate drivers are output to the respective TFT array regions in the prior art. As shown in FIG. 1, the two gate drivers drive different TFT array regions respectively, so that they are arranged at different positions in the display panel. Therein, reference number 11 indicates the drive control signal obtained after the gate drive signal outputted by the first gate driver is finally output to the corresponding TFT array region, and reference number 12 indicates the drive control signal obtained after the gate drive signal output by the second gate driver is finally output to the corresponding TFT array region, and they are both voltage pulse signals. Since the wiring from the second gate driver to the TFT array region driven by it is longer than the wiring from the first gate driver to the TFT array region driven by it, due to the delay (e.g., RC (resistance-capacitance) Delay) generated by the wiring, the rising times of the voltage pulse signals 11 and 12 are significantly different, so that for different TFT array regions, the driving capabilities of the drive control signals received by them are not equalized.

Thus, for different TFT array regions, the driving capabilities of the received drive control signals are either unbalanced or inconsistent, i.e., the time periods taken by the drive control signals to rise from VGL to VGH are different; this unbalance results in a "splitting-screen" phenomenon arising during display (e.g. arising in a reliability test of the display panel under low temperature etc.).

Of course, due to the difference between the different gate drivers by themselves, the driving capabilities of the gate drive signals output by them are different by themselves. For example, even though a same type of chip produced by a same manufacturer is used, due to fluctuations in the process of semiconductor manufacturing and other reasons, the driving capabilities of the gate drive signal output by them are more or less different. If the driving capability difference of gate drive signals is ultimately reflected in the drive control signals finally received by the TFT array regions, the above splitting-screen phenomenon is generated due to the unbalanced driving capabilities.

Figure 2:
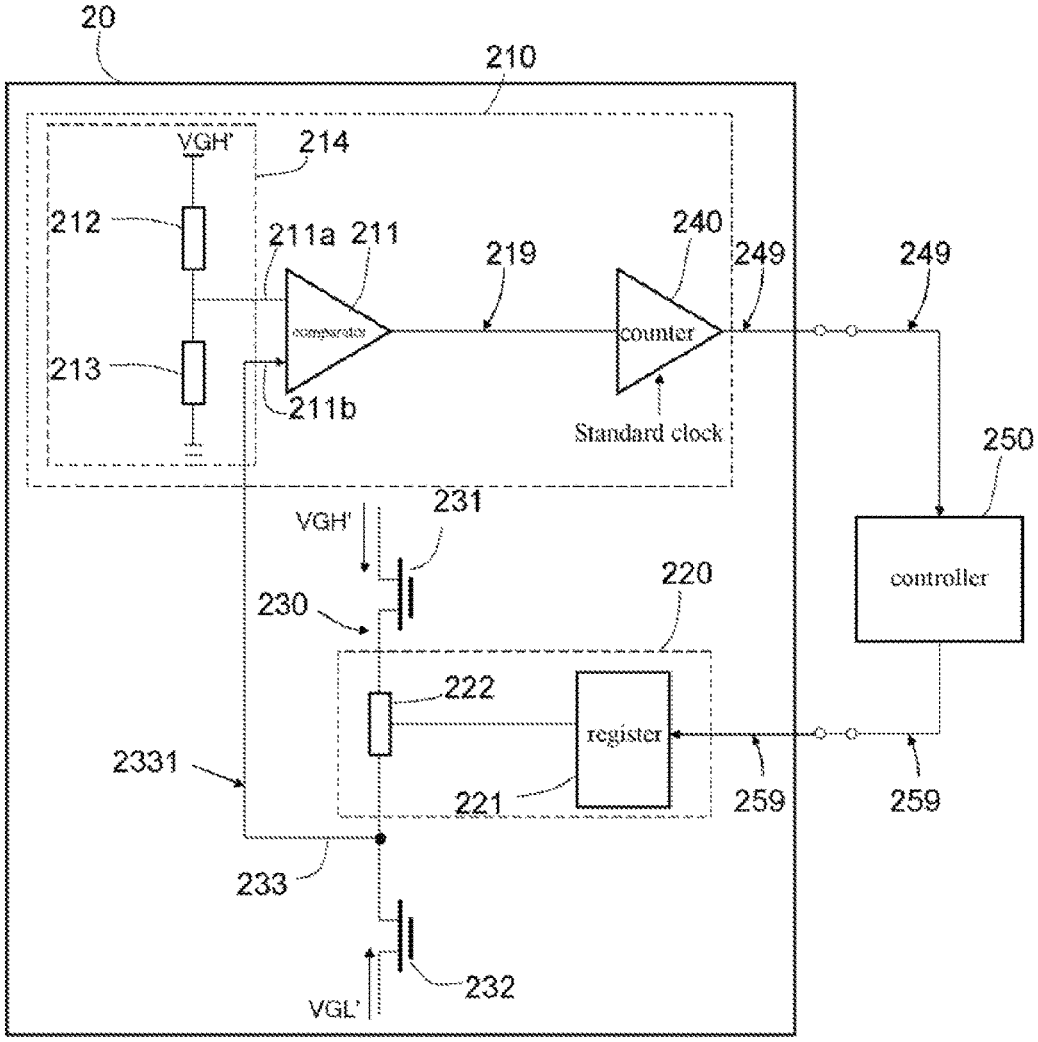
FIG. 2 is a modular structure schematic diagram of a module structure of a gate driver according to an embodiment of the present disclosure.
Figure 3:
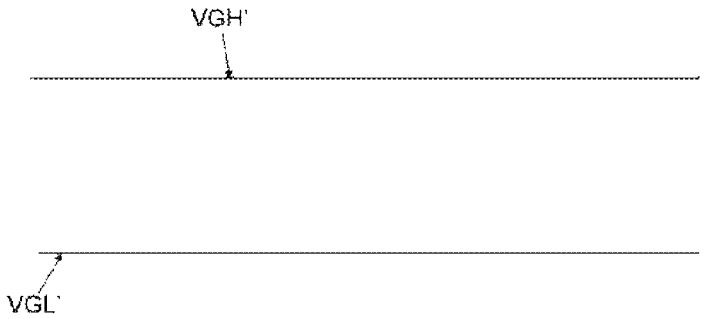
FIG. 3 shows a signal source provided by the gate driver of the embodiment shown in FIG. 2 for generating a gate drive signal.

FIG. 2 shows a modular structure schematic diagram of a gate driver according to an embodiment of the present disclosure. FIG. 3 shows a signal source for generating a gate drive signal provided by the gate driver of the embodiment shown in FIG. 2. In this embodiment, the gate driver 20 exemplarily configurably adjusts the driving capability of the gate drive signal output by it.

As shown in FIG. 2, the gate driver 20 mainly includes a driving capability detection module 210 and a driving capability adjustment module 220. By way of example, the output of the gate driver 20 is through the push-pull output circuit 230, which may provide an output terminal and output an output signal of the gate drive signal. The push-pull output circuit 230 may be specifically formed by MOS transistors connected in series. In the example as shown in FIG. 2, the push-pull output circuit 230 comprises MOS transistors 231 and 232 connected in series (other components of the push-pull output circuit 230 are not shown in the figure). VGH' of the signal source as shown in FIG. 3 is input to the MOS transistor 231, and VGL' of the signal source as shown in FIG. 3 is input to the MOS transistor 232. Therein, the VGH' has a higher voltage (e.g., 34V), which is provided to the gate driver 20 to generate a high level VGH of the gate drive signal in the form of voltage pulse signal; VGL' has a lower voltage (e.g., −8V), which is provided to the gate driver 20 to generate a low level VGL of the gate drive signal in the form of voltage pulse signal.

Still as shown in FIG. 2, the acquisition terminal 233 is provided on the push-pull output circuit 230. In this embodiment, the acquisition terminal 233 is provided at the node between the digital potentiometer 222 of the driving capability adjustment module 220 and the MOS transistor 232. Thereby the acquisition terminal 233 acquires the signal at the output of the gate driver 20 and the feedback signal 2331 may in turn reflect the characteristic of the gate drive signal output by the gate driver 20; in this embodiment, the feedback signal 2331 may just be the output signal of the gate driver 20, that is, the gate drive signal. Therein, the driving capability adjustment module 220 is provided on the push-pull output circuit 230. In particular, the push-pull output circuit 230 is in series connection with a digital potentiometer 222 of the driving capability adjusting module 220 which functions as the driving capability adjusting component, and the digital potentiometer 222 is arranged in series between the MOS transistor 231 and the MOS transistor 232 of the push-pull output circuit 230. Also, the driving capability adjustment module 220 further includes a register 221 which can be used to configurably store the adjustment instruction in the form of detection signal and to output the adjustment instruction to adjust the resistance value of the digital potentiometer 222. Thus the rising time taken by the gate drive signal output by the gate driver 20 to change from the VGL to the VGH becomes adjustable, and in turn the driving capability thereof becomes adjustable. The adjustment instruction is input from outside, so that the driving capability of the gate driver 20 becomes adjustable.

In this embodiment, before the gate driver 20 leaves the factory, a register 221 of each gate driver 20 is configured with a corresponding adjustment instruction so that a plurality of gate drive signals output from the plurality of gate drivers 20 are operably configured, until the TFT array substrate driven by the plurality of the gate drivers 20 does not exhibit a splitting-screen phenomenon substantially during display operation (e.g., under low temperature and other reliability test conditions).

It should be noted that, in other embodiments, a digital capacitor may be used to replace the digital potentiometer 222 to realize the function of the driving capability adjustment component, and the function of the driving capability adjustment component may be realized by a circuit formed by a digital potentiometer or a digital capacitor.

Still as shown in FIG. 2, the acquisition terminal 233 is coupled to an input terminal 211*b* of a comparator 211 of the driving capability detection module 210 so that the feedback signal 2331 is input to the comparator 211; and the other input terminal 211*a* of the comparator 211 is input with a reference voltage signal. In this embodiment, the comparison sub-module further includes a reference voltage signal providing sub-module 214 which includes a resistor 212 and a resistor 213 arranged in series. The input terminal 211*a* of the comparator 211 is electrically connected to a node between the resistor 212 and the resistor 213 so as to acquire the input reference voltage signal. Specially, the reference voltage signal may be generated using VGH' as shown in FIG. 3. The first end of the resistor 212 is input with the VGH', and the second end thereof is connected in series to the first end of the resistor 213, and the second end of the resistor 213 is grounded. The sizes of the resistance values of the resistor 212 and the resistor 213 may be set according to the size of the reference voltage signal to be obtained as required. In one example, the reference voltage of the reference voltage signal is 90% of the high level VGH of the gate drive signal to be generated.

The comparator 211 compares the feedback signal 2331 with the reference voltage signal to determine whether or not the gate drive signal as the feedback signal 2331 has successfully risen from the low level to the reference voltage. The comparator 211 outputs a comparison output signal 219 (for example, a high level) at the moment of the feedback signal 2331 rising from the low level to the reference voltage, and the comparison output signal 219 is sent to a counter 240 in the driving capability detection module 210 which is used for timing sub-module. The counter 240 counts the standard clock signal under the control of the comparison output signal 219 and starts to count from the time point when the gate drive signal starts rising from the VGL until the time point at which the comparison output signal 219 is received, and then the count result is obtained and the signal 249 is output. The output count result reflects the rising time of the gate drive signal from VGL to VGH, i.e., reflects its driving capability, so that the driving capability detection module 210 realizes real-time detection of the driving capability of the gate drive signal currently outputted by the gate driver 20, with the signal 249 as the detection signal.

Figure 4:
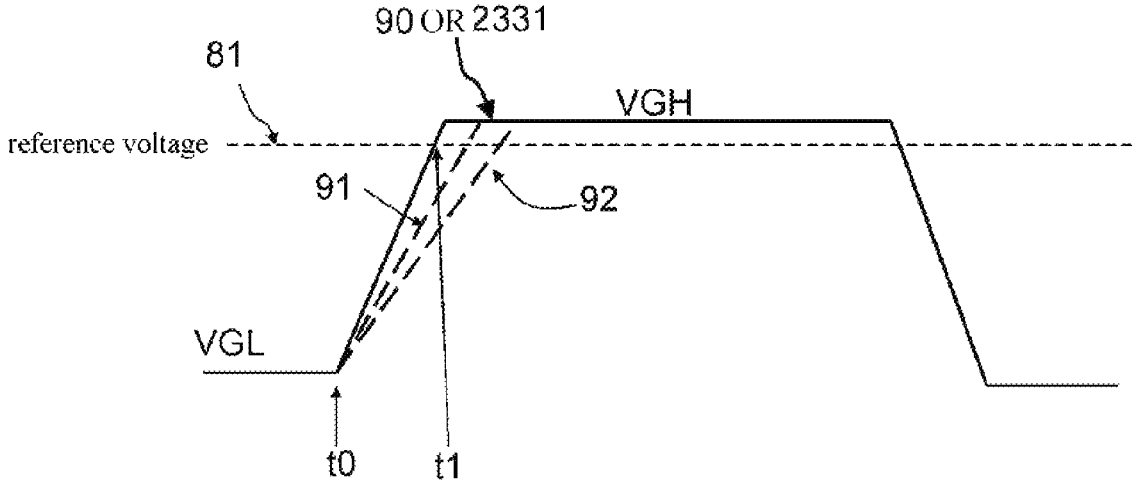
FIG. 4 is a schematic diagram of a gate drive signal outputted from a gate driver according to an embodiment of the present disclosure.

The driving capability detection principle described above is explained by an example of the gate drive signal 90 shown in FIG. 4. Therein the voltage pulse signal shown by the solid line is the gate drive signal 90, which is also the feedback signal 2331 as described above, including the low level VGL and the high level VGH; wherein the horizontal dotted line shows the reference voltage signal 81, which is obtained by dividing the VGH' as shown in FIG. 3. The comparator 211 compares the input reference voltage signal 81 with the feedback signal 2331, and the counter 240 counts the standard clock from the time point t0, and at the time point t1, i.e., at the moment when the feedback signal 2331 rises from the low level VGL to the reference voltage, the comparator 211 may output the comparison output signal 219 to the counter 240, and then the counter terminates the counting, thereby obtaining the count result. The count result is output as the detection signal 249. Thus, it will be understood that the count result of the detection signal 249 actually reflects the duration from t0 to t1, and the counter 240 is substantially used as a timing sub-module that can measure the time taken by the gate drive signal 90 to rise from VGL to the reference voltage.

The timing sub-module may include a clock module for providing the standard clock signal, which module may be embodied by a crystal oscillator within a chip. It will be understood that the standard clock and reference voltage must have sufficient stability as much as possible to avoid errors due to fluctuations, that is, to facilitate improving the detection accuracy for the driving capability.

Figure 5:
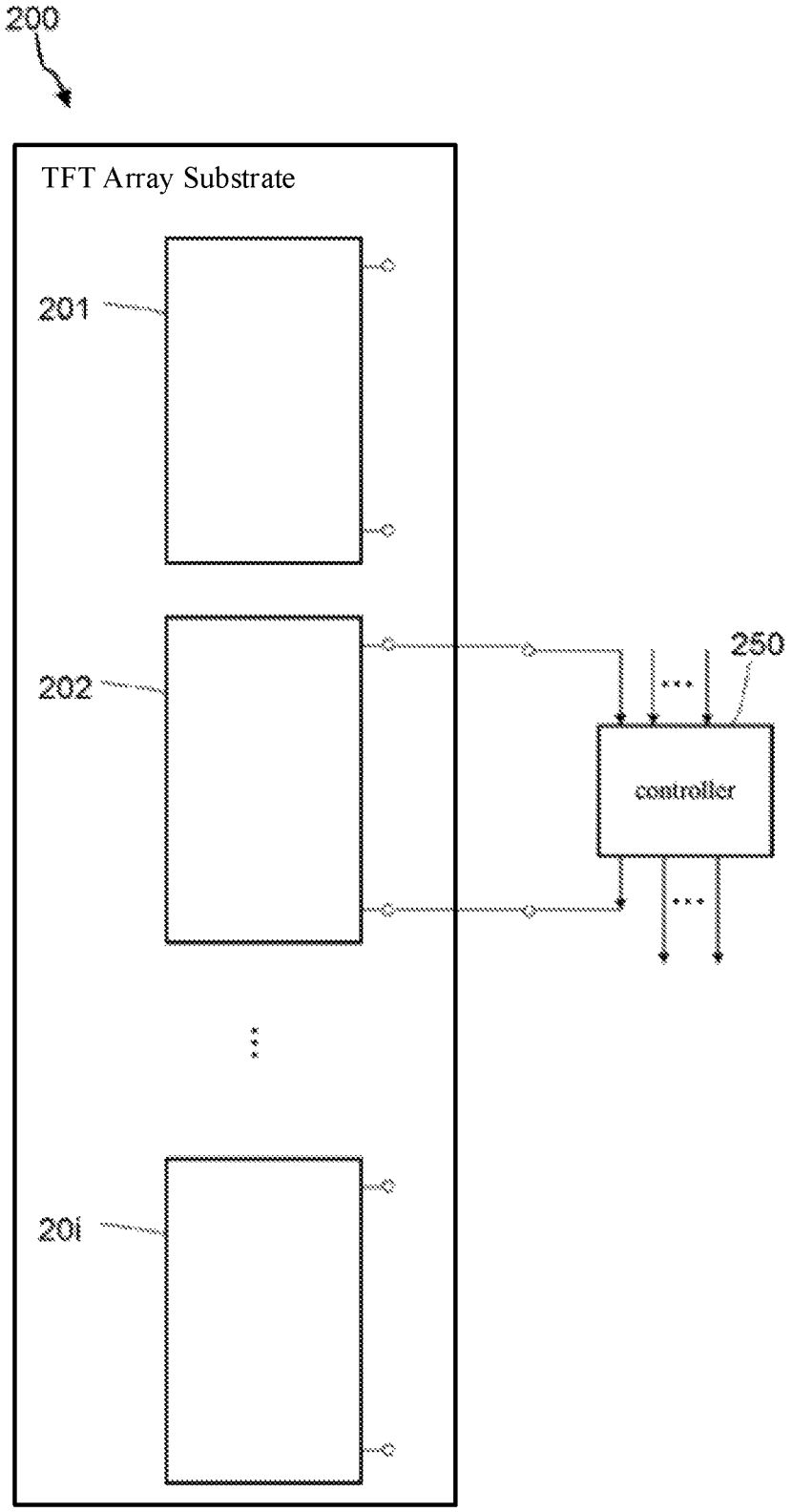
FIG. 5 is a modular structure schematic diagram of a configuration system according to an embodiment of the present disclosure.

Still as shown in FIG. 2, the detection signal 249 output from the gate driver 20 is input to an external controller 250, which belongs to the configuration system of the embodiment of the present disclosure (as shown in FIG. 5). The controller 250 may be but is not limited to be, embodied by a TCON (count control register). The detection signal 249 may be transmitted via a communication line such as I2C, and the detection signal 249 may be output through the external pin of the gate driver 20 and transmitted to the controller 250 via an I2C communication line external to the gate driver 20. It will be understood that the controller 250 may simultaneously receive the detection signals 249 of the plurality of different gate drivers 20 through a plurality of channels and store the detection signals. A plurality of different detection signals 249 are compared in the controller 250 and corresponding adjustment instructions 259 are output corresponding to each of the gate drivers 20 in accordance with the comparison results. The adjustment instructions 259 specifically are also digital signals, which are then input to the register 221 and stored. Therefore, it is possible to adjust the resistance value of the digital potentiometer 222 based on the adjustment instruction 259 and in turn adjust the rising time of the gate drive signal of the gate driver 20, that is, realize adjusting the driving capability thereof.

In particular, the gate driver 20 may be specifically implemented by an IC, and at least the driving capability detection module 210 and the driving capability adjustment module 220 described above are integrated within the IC. The other components included in the gate driver 20 are for example achievable and well known by those skilled in the art and are not specifically described herein.

FIG. 5 is a modular structure schematic diagram of a configuration system according to an embodiment of the present disclosure. In this embodiment, the configuration system 200 is used to configure the driving capabilities of the gate drivers of the plurality of gate drivers 20, for example, to configure the driving capabilities of the gate drivers 201, 201 to 20*i*, where i is an integer greater than or equal to 2. The specific number of gate drivers is not limited. Also, the gate drivers 201, 201 to 20*i* are used to drive a same TFT array substrate, and in an actual TFT-LCD product, the gate drivers 201, 201 to 20*i* are arranged at different positions.

As shown in FIG. 5, the configuration system 200 mainly includes a controller 250 and the configured gate drivers 201, 202 to 20*i*. In the configuration process, the detected detection signals 249 as shown in FIG. 2 outputted by the gate drivers 201, 202 to 20*i* respectively may be stored in the controller 250 respectively, so that a plurality of detection signals 249 are compared to achieve outputting different adjustment instructions for different gate drivers 201, 202 to 20*i* respectively, so that it is realized that after the gate drive signals output from the gate drivers 201, 202 to 20*i* are respectively transmitted to the respective TFT array regions of the TFT array substrate, the driving capabilities of the drive control signals obtained by the TFT array regions are relatively uniform within the allowable error range. In this way, the equalization of the driving capabilities of the drive control signals received in the different TFT array region is achieved, and when the configured gate drivers 201, 202 to 20*i* are based on for driving the TFT array substrate on s same display panel, the splitting-screen phenomenon would not occur.

It should be noted that the above configuration process may be performed under a reliability test condition such as a low temperature, and the gate drive signals 90 outputted from the gate drivers 201, 202 to 20*i* are output to the corresponding TFT array regions through external wirings on the TFT array substrate. It is possible to determine whether or not the gate drivers 201, 202 to 20*i* have been successfully adjusted by judging whether or not the display effect of the display panel has a splitting-screen phenomenon.

Figure 6:
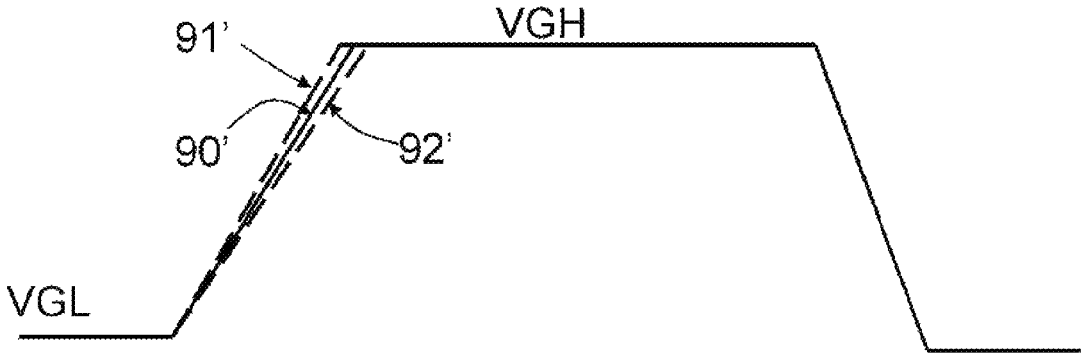
FIG. 6 shows a drive control signal obtained after the gate drive signal outputted from the configured gate driver is transmitted through the wiring between the gate driver and the TFT array region.

The below are described with configuring three gate drivers 201, 202, and 203 as an example. FIG. 6 shows drive control signals obtained by transmitting the gate drive signals outputted from the configured gate drivers via the wiring between the gate drivers and the TFT array regions. As shown in both FIGS. 4 and 6, the lengths of the external wirings corresponding to the three gate drivers 201, 202, and 203 are successively shortened, so that the delays to the gate drive signals are reduced in succession. It is assumed that the three gate drivers 201, 202 and 203 before configuration all output the gate drive signal 90 as shown in FIG. 4, i.e., the gate drive signals output by the three gate drivers 201, 202 and 203 have same driving capability. As such, the driving capability configuration rule can be configured in the controller 250, and based on the driving capability configuration rule, the rising times of the gate drive signals of the three gate drivers 201, 202 and 203 can be made longer successively in order to compensate for the delay effect of the external wirings on their gate driving Signals. Specifically, the driving capability configuration rule may be for example that, the values of the detection signals 249 of the configured gate drivers 201, 202 and 203 are required to be 7, 8 and 9 respectively (the numerical value reflects the rising time). In the case where the initial gate drive signals 90 of the three gate drivers 201, 202 and 203 are the same, the detection signals 249 outputted by them respectively are substantially identical, e.g. the value is 7 (before configured). The comparison calculation is performed based on their detection signals 249 and the driving capability configuration rule, and different adjustment instructions 259 are output to the gate drivers 201, 202 and 203, respectively. The gate drive signals outputted by the configured gate drivers 201, 202 and 203 are respectively changed as shown in 90, 91, 92 (as shown in FIG. 4). The values of the obtained detection signals 249 based on the gate drive signals 90, 91, 92 which are fed back are 7, 8, 9 respectively (i.e., the rising times are successively increased); correspondingly, the drive control signals obtained by the TFT array regions respectively driven by the gate drivers 201, 202 and 203 will be 90', 91', 92' (as shown in FIG. 6), that is, within the allowable error range. It may indicate that the driving capabilities of the drive control signals 90', 91', 92' are substantially equalized.

The equalization of the above drive control signals 90', 91', 92' is achieved by compensating for the different delays of the external wiring to the gate drive signals 90, 91, 92. Thus, based on the disclosure of this principle, those skilled in the art can specifically set the above-described driving capability configuration rule in accordance with the different external wiring conditions of the gate drive controllers.

The above example are described in case that the initial gate drive signals outputted by the three gate drivers 201, 202, and 203 are identical, and the delays caused by the external wirings to which they correspond respectively are different from each other. Hereinafter, the way of configuring the gate drivers 201, 202, and 203 are further illustrated in the case that the gate drive signals outputted from the three gate drivers 201, 202, and 203 are different and the delays caused by the external wirings to which they correspond respectively are same with each other.

As shown in both FIGS. 4 and 6, it is assumed that the gate drive signals outputted by the gate drivers 201, 202 and 203 correspond to 90, 91, 92 (as shown in FIG. 4), respectively. That is to say, they have different driving capabilities. Before configuration, the detection signals 249 can be outputted by the driving capability detection module 210, and the values of the detection signals 249 are 7, 8, 9 respectively (the numerical value reflects the rising time). Assuming that the external wiring conditions are the same, it is likely that a splitting-screen phenomenon will occur if a same display panel is driven by the three gate drive signals 90, 91, 92. In view of the external wiring conditions being the same, the driving capability configuration rules configured in the controller may be for example that, the values of the detection signals 249 of the configured gate drivers 201, 202 and 203 are required to be 9, 9, 9, respectively (the value reflects the rising time). The comparison calculation is performed based on the detection signals 249 output from the gate drivers 201, 202 and 203 respectively and the driving capability configuration rule, and different adjustment instructions 259 are output to the gate drivers 201, 202 and 203, respectively, so that the driving capabilities of the gate drive signals outputted by the configured gate drivers 201, 202 and 203 respectively are substantially the same (within the allowable range of error); correspondingly, the drive control signals obtained by the TFT array regions driven by the gate drivers 201, 202, and 203 respectively are 90', 91', 92' respectively (as shown in FIG. 6), which are within the allowed range of error. It may indicate that the driving capabilities of the drive control signals 90', 91', 92' are substantially equalized.

It should be noted that the difference in driving capabilities of the gate drive signal output from the above-mentioned gate drivers 201, 202 and 203 can be caused by various factors such as unequal driving capabilities due to accuracy fluctuation of the manufacturing process of the gate driver.

Therefore, the setting of the driving capability configuration rule in the controller 250 can be actively set according to the specific actual situation. For example, if the initial driving capabilities of the plurality of gate drivers are the same, the driving capability configuration rule is set according to the external wiring conditions; and if the external wiring conditions to which the plurality of gate drivers correspond are the same, the driving capability configuration rule described above is set according to the driving capability difference of the gate drive signals output by the plurality of gate drivers. Of course, it will be understood that if there is a difference in the driving capability between the plurality of gate drivers and the external wiring conditions are not coincident, the driving capability configuration rule is set according to both the driving capability difference of the gate drive signals output from the plurality of gate drivers and the external wiring conditions to which the plurality of gate drivers correspond. For those skilled in the art, according to the above teachings or disclosures, it is entirely possible that the driving capability difference of the gate drive signals output from the plurality of gate drivers and the external wiring conditions corresponding to the plurality of gate drivers (in the case of the mounting positions thereof being determined) can be determined. Therefore, despite the driving capabilities of the drive control signals received by the different TFT array regions are not equalized for any reason, the driving capabilities of the drive control signals can be equalized by the above configuration process, thereby eliminating the splitting-screen phenomenon.

Preferably, the above configuration process may be performed prior to the mass production of the display panel, and without considering the difference between the gate drivers themselves, after determining adjustment instructions for the gate driver at the respective positions, the corresponding adjustment instructions can be directly configured in the registers of the gate drivers at the respective positions.

It will be appreciated that when the component is "connected" or "coupled" to another component, it may be directly connected or coupled to another component or there may be intermediate components between it and another component.

The above example mainly describes the drive controller, the configuration system, and the configuration method thereof of the present disclosure. While only some of the embodiments of the present invention have been described, it will be understood by those of ordinary skill in the art that the invention may be embodied in many other forms without departing from the spirit and scope thereof, for example, the corresponding adjustment instructions are configured and stored by the use of other storage device similar to the registers 221. Accordingly, the illustrated examples and embodiments are to be considered as illustrative and not restrictive, and that the invention may include various modifications and replacements without departing from the spirit and scope of the invention as defined by the appended claims.

The invention claimed is:

1. A gate driver for providing a gate drive signal for a thin film transistor array substrate, the gate driver comprising:

a driving capability detector configured to receive at least the gate drive signal and to detect a driving capability of the gate drive signal based at least on the gate drive signal, the driving capability being represented by a rising time taken by the gate drive signal in form of a voltage pulse signal to rise from a low level to a high level, wherein the driving capability detector is further configured to output a detection signal indicative of the driving capability to an external controller;

a register configured to receive and store an adjustment instruction in form of a digital signal from the external controller;

a push-pull output circuit comprising a first MOS transistor and a second MOS transistor connected in series; and a driving capability adjustor connected in series with the first and second MOS transistors and between the first and second MOS transistors, wherein the driving capability adjustor is configured to adjust the driving capability of the gate drive signal in response to the adjustment instruction stored in the register.

2. The gate driver according to claim 1, wherein the driving capability detector comprises:

a comparator comprising a first input end to receive a reference voltage and a second input end to receive the gate drive signal, wherein the comparator is configured to compare the gate drive signal with the reference voltage to determine whether the gate drive signal has risen from a low level to the reference voltage; and a counter configured to determine a time period taken by the gate drive signal to rise from the low level to the reference voltage and to output a count value indicative of the time period.

3. The gate driver according to claim 2, wherein the counter is configured to determine the time period using a standard clock signal and to output the count value as the detection signal.

4. The gate driver according to claim 2, wherein the driving capability detector comprises a voltage divider comprising a first resistor and a second resistor connected in series, wherein the voltage divider is configured to provide the reference voltage, and wherein the first input end of the comparator is electrically connected to a node connected between the first resistor and the second resistor to receive the reference voltage.

5. The gate driver according to claim 1, wherein the driving capability adjustor is selected from a group consisting of a digital potentiometer, a digital capacitor, and a circuit formed by a digital potentiometer or a digital capacitor.

6. The gate driver according to claim 1, wherein the first MOS transistor is connected to a signal source having a high level, and the second MOS transistor is connected to a signal source having a low level; and wherein the push-pull output circuit is configured to output the gate drive signal at a node connected between the second MOS transistor and the driving capability adjustor.

7. The gate driver according to claim 1, wherein the detection signal is a digital signal.

8. A configuration system for configuring driving capabilities of a plurality of gate drivers, the plurality gate drivers being used for driving different thin film transistor array regions of a thin film transistor array substrate, the configuration system comprising:

a controller; and the plurality of gate drivers, wherein each gate driver comprises:

a driving capability detector configured to receive at least a gate drive signal and to detect a driving capability of the gate drive signal based at least on the gate drive signal, the driving capability being represented by a rising time taken by the gate drive signal in form of a voltage pulse signal to rise from a low level to a high level, wherein the driving capability detector is further configured to output a detection signal indicative of the driving capability to the controller;

a register configured to receive and store an adjustment instruction in form of a digital signal from the controller;

a push-pull output circuit comprising a first MOS transistor and a second MOS transistor connected in series; and a driving capability adjustor connected in series with the first and second MOS transistors and between the first and second MOS transistors, wherein the driving capability adjustor is configured to adjust the driving capability of the gate drive signal in response to the adjustment instruction stored in the register, wherein the controller is configured to store a plurality of the detection signals output from respective ones of the plurality of gate drivers and to compare the detection signals to generate and output respective adjustment instructions to the respective ones of the plurality of gate drivers.

9. The configuration system according to claim 8, wherein the plurality of gate drivers are provided on a same thin film transistor array substrate.

10. The configuration system according to claim 8, wherein the controller is configured with a driving capability configuration rule and is configured to output the adjustment instructions based on a comparison result between the configuration rule and the detection signals.

11. The configuration system according to claim 10, wherein the driving capability configuration rule is set according to at least one of a) driving capability differences between the gate drive signals output by the plurality of gate drivers, or b) external wiring conditions corresponding to the plurality of gate drivers.

12. The configuration system according to claim 8, wherein each of the plurality of gate drivers comprises an external pin to output the detection signal.

13. A method of using the configuration system of claim 8, the method comprising:

receiving, by the driving capability detectors of the plurality of gate drivers, respective gate drive signals output from the plurality of gate drivers;

detecting, by the driving capability detectors of the plurality of gate drivers, driving capabilities of respective ones of the gate drive signals;

outputting, by the driving capability detectors of the plurality of gate drivers, respective detection signals that reflect the driving capabilities of the gate driving signals; and comparing, by the controller, the respective detection signals to output respective adjustment instructions to the gate drivers; and adjusting, by the driving capability adjustors of the plurality of gate drivers, the driving capabilities of the gate drive signals in accordance with the adjustment instructions.

14. The method according to claim 13, wherein the plurality of gate drivers are provide on a same thin film transistor array substrate, the method further comprising driving the same thin film array substrate with the adjusted gate drive signals output from the plurality of gate drivers.

15. The method according to claim 13, further comprising generating, by the controller, the respective adjustment instructions based on a comparison result between a pre-set driving capability configuration rule and the detection signals.

16. The method according to claim 15, wherein the driving capability configuration rule is set according to at least one of driving capability differences between the gate drive signals output by the plurality of gate drivers, or external wiring conditions corresponding to the plurality of gate drivers.

* * * * *